US006427876B1

(12) United States Patent
Fuchs

(10) Patent No.: US 6,427,876 B1
(45) Date of Patent: Aug. 6, 2002

(54) MEDIA DISPENSER WITH INTEGRALLY FORMED, SEPARABLE AND COMPLEMENTARY NOZZLE PARTS

(75) Inventor: Karl-Heinz Fuchs, Radolfzell (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 0 days.

(21) Appl. No.: 09/412,671

(22) Filed: Oct. 5, 1999

(30) Foreign Application Priority Data

Oct. 6, 1998 (DE) ..... 198 45 910

(51) Int. Cl.[7] ..... B65D 88/54
(52) U.S. Cl. ..... 222/321.2; 222/321.7
(58) Field of Search ..... 222/190, 321.2, 222/321.4, 321.7, 321.9, 401, 402, 402.18

(56) References Cited

U.S. PATENT DOCUMENTS 4,402,432 A * 9/1983 Corsette ..... 222/321.2
4,773,562 A 9/1988 Gueret ..... 222/135
5,348,189 A * 9/1994 Cater ..... 222/321.2
5,752,627 A * 5/1998 Vandromme et al. .... 222/321.7
5,884,819 A * 3/1999 Fuchs et al. ..... 222/321.2
5,992,704 A 11/1999 Jager-Waldau ..... 222/341
6,155,496 A 12/2000 Brunet et al. ..... 239/333

FOREIGN PATENT DOCUMENTS

| | | |
|---|---|---|
| DE | 34 20 961 C2 | 12/1984 |
| DE | 43 42 680 A1 | 6/1995 |
| DE | 196 05 153 A1 | 8/1997 |
| DE | 196 06 701 A1 | 8/1997 |

* cited by examiner

*Primary Examiner*—Joseph A. Kaufman
(74) *Attorney, Agent, or Firm*—Quarles & Brady LLP

(57) ABSTRACT

A dispenser includes a nozzle body (3) which is mounted to an actuating head (2) parallel to a center axis (10) of the dispenser. Within the head (2) the despenser includes an air pump (33) which ports into the nozzle body (3) additionally to ducts for the liquid medium. Head (2) may be preassembled with the associated pump piston (41) to provide a unit which is axially mounted on a thrust piston pump (32) for the liquid medium. Thereby piston (41) snaps into a flanged rim (42) of a crimp ring (39) which thus positively connects piston (41) to the pump base.

24 Claims, 3 Drawing Sheets

MEDIA DISPENSER WITH INTEGRALLY FORMED, SEPARABLE AND COMPLEMENTARY NOZZLE PARTS

TECHNICAL FIELD AND BACKGROUND OF THE INVENTION

The invention relates to a media dispenser for solid or fluid media i.e., gaseous, liquid, pasty, creamy or powder/bulk media. The dispenser is held in one hand and simultaneously actuated for discharge. It can be made for only a single medium discharge on a return stroke. Most, if not all, of the dispenser components are injection-molded or made from plastics material.

A pair of shaped elements such as a support and an insert countersunk in the support are formed around a shaping axis and a duct axis is oriented transverse to the shaping axis. After congealing these molded elements are withdrawn from the mold in a direction parallel to a mold axis. The function of the shaping elements is to guide the medium flow parallel to the duct axis. Such shaped elements may be provided at any location in the dispenser, e. g. as two housing parts of a pump, of a valve, of a piston unit, of a discharge head or the like or they may be two valve bodies. They may also be sections of a medium conduit. As regards further features and functional details incorporated in the present invention, reference is made to U.S. Pat. No. 6,257,461 issued Jul. 10, 2001.

OBJECTS OF THE INVENTION

An object of the invention is to provide a dispenser which obviates the disadvantages of known constructions.

Another object is to provide a dispenser simple to manufacture or to assemble.

A further object is to enable to collect different medium flows or media.

Still another object is to achieve smooth transitions between adjoining exterior faces of the shaped elements.

Another object is to enable atomization of the medium.

SUMMARY OF THE INVENTION

According to the invention, an insert, such as a nozzle cap, is inserted into a support, such as an actuator cap, in a direction transverse to the medium duct which traverses the insert. The two shaped elements may be manufactured in one part, in a common mold, in direct interconnection or as separate parts. The elements include first and second duct conduits e.g. so that these conduits traverse gaps or joints between the two elements. Each of the conduits may guide flows of any of the cited media, i.e. the first conduit is provided for a non-gaseous medium and the second conduit for a gas, such as air. Thus these two media are fed transversely to each other, mixed and then discharged to the environment downstream thereof.

The molded elements contact faces or tensioning faces sealingly contacting each other, are oriented transverse to the duct axis and surround this axis to provide a seal. On assembly, the contact faces slide on each other with increasing compressive tension until a firm seat is attained in the end position. Thus a self-locking rigid seat is attained simply by frictional connection and without any additional positive locking or snap members. The two contact faces may commonly form length bounds of the second conduit and may be traversed by the first conduit.

The insert has larger exterior faces transversely connecting to edge faces. One of these exterior faces may be entirely without contact relative to the support. For that, the other and remote exterior face is a rail-shaped positive-locking profile to be engaged with a counter member of the support. Thus only a single degree of motion freedom exists, namely, in the insertion direction of the insert. In all other directions the guidance and connection is accomplished with zero clearance between the faces. Thereby one of the two elements has spaced apart and juxtaposed projections. Each of these projections forms an engagement as described without motion or play in a counter profile of the other element. Thus strength and sealing are increased. This is also achievable when—prior to insertion—contact faces are provided on the two elements with some portions of these opposable faces being aligned and with other portions being mutually and transversely offset. Thus, on insertion, the aligned faces guide the offset faces to cause the latter to slide on each other with high compressive tension.

Three or more shaped elements of the cited kind may also be provided and assembled as described. Thereby one element may be both a support and an insert, i. e. located between a further insert and the support. In production, or at the start of assembly, these elements are mutually lined up and interconnected parallel to the insert direction or in one part. Thereafter they are telescoped parallel to the shaping axis of the largest of the elements or of the main support.

The dispenser has a flow-obstruction port or damming passage to boost the medium pressure. The damming section is commonly housed by the insert and the support. The damming section is a throttle cross-section or a valve of the second conduit and is located between insert and support or between two inserts.

The bounds or the movable respective resilient valve body of the damming section may be constructed in one part with one or all shaped elements.

The second pressure chamber is located entirely within the support. This chamber is bounded by a piston which is movably mounted relative to the support, preassembled with the support and then combined with the remaining dispenser assembly. Thus a discharge head and the piston are a unit which may be axially mounted on a pump casing whereby the piston is automatically secured and locked against axial withdrawal from this casing. Then the piston can perform the actuating or stroke relative to the head. The pressure chamber of the thus formed pump directly adjoins the gap between the contact faces of the support and of the insert. Axial locking of the piston is done directly on a retaining member, such as a crimp ring, fixedly or tensionally connecting a pump housing of the first compression chamber to a reservoir.

To achieve a sufficiently high pressure, especially gas pressure, in the second pressure chamber the end wall thereof, which opposes the piston, is axially set back relative to the medium outlet or the duct axis thereof. Thus in the relatively small second pressure space a high compression is achieved up to full-contact abutment of the piston on the end wall.

To further boost the pressure of the medium in the second conduit a prestroke may also be provided which initially compresses only the second medium, whereafter the first medium is compressed and delivered together with the second medium into the cited conduits.

BRIEF DESCRIPTION OF THE DRAWINGS

Example embodiments of the invention are explained in more detail in the following and illustrated in the drawings in which.

DETAILED DESCRIPTION

Figures 1, 2, 3:
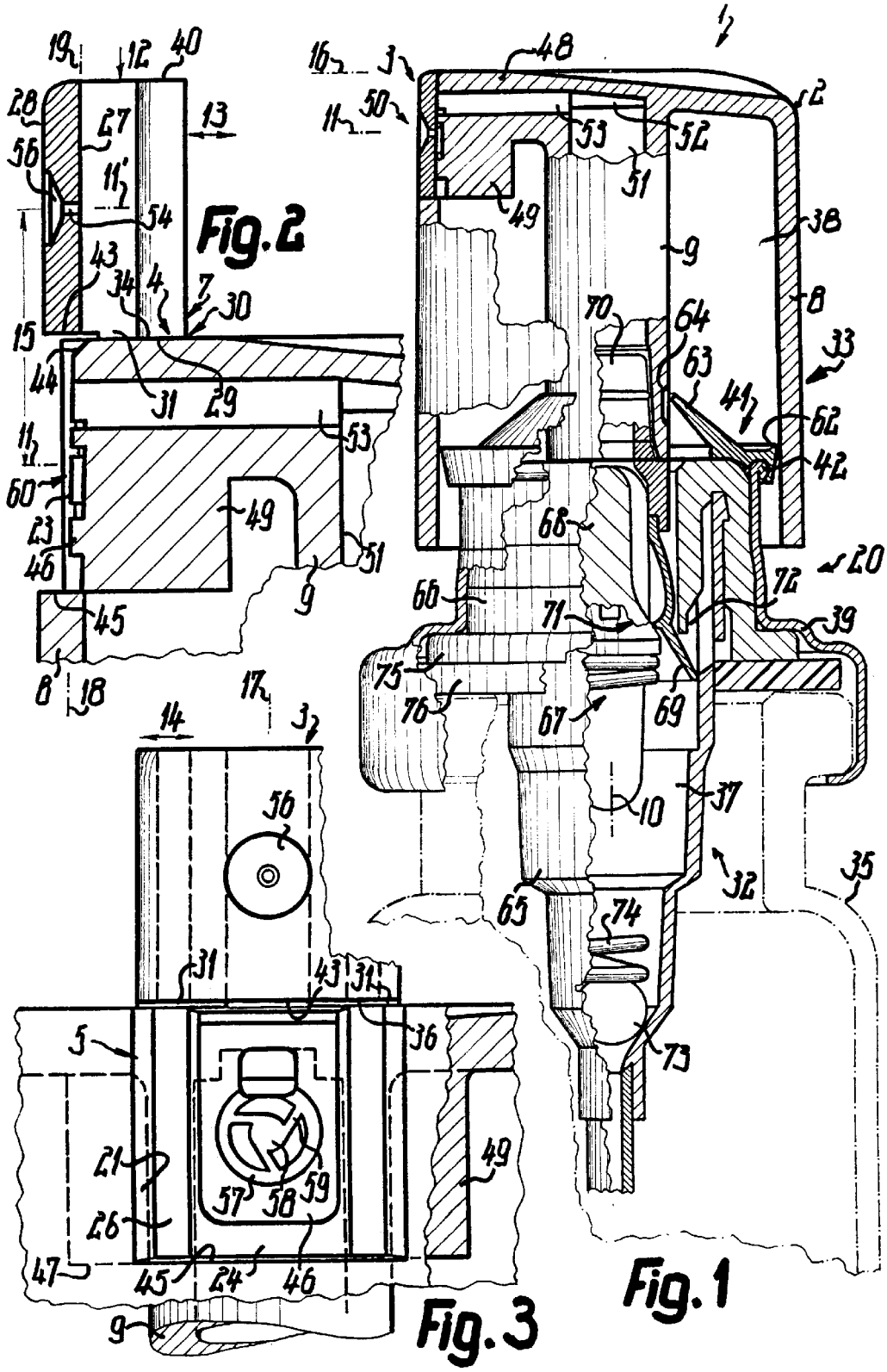
FIG. 1 is an axial section of a dispenser according to the invention in the initial or rest position.
FIG. 2 is a detail taken from FIG. 1 and shown on a magnified scale, but in the casting or shaping condition of the shaped element.
FIG. 3 is a view of the arrangement as shown in FIG. 2 from the left.

All elements or parts shown in the drawings are injection-molded of a plastics material, e.g. polyethylene. The assembly unit shown in FIGS. 1 to 5 is assembled from two components or shaped elements 2, 3 and provides a discharge actuating head. Support 2 is cap-shaped and insert 3 is a nozzle body or cap of U-shaped cross-section. Insert 3 is freely accessible on the outer or exterior side of support 2. During production in the mold or die, the insert 3 entirely freely projects from the outside of support 2 to which insert 3 is joined solely by a tiny binding or connection 4, so as to be slightly tiltable. As the binding 4 is about to be fractured, the insert 3 is urged into support 2 until its outer face adjoins the outer circumference and outer end face of support 2 as a smooth continuation and without gaps or spacings.

Support 2 forms a guide 5 which includes projections and recesses for receiving insert 3 without play between the parts. The outer end of guide 5 forms a female recess 6 corresponding to a male stamping tool on which binding 4 is sheared off on insertion. Thereby the end of insert 3 forms the punch 7 with a precise gap-free fit in recess 6. Guide 5 extends up to the outside of an outermost shell 8 of support 2. A hollow shaft 9 is provided within and radially spaced from shell 8. Members 8,9 are coaxial. The center or shaping axis 10 of elements 2, 3 is perpendicular to duct axis 11. On discharge the medium flows parallel to axis 11 through elements 2, 3.

During transfer from the casting position to the intended operational position, the insert 3 is shifted parallel to axis 10 and perpendicular to axis 11 in insert direction 12 until the duct axis 11 is translated from position 11' via travel distance 15 to position 11. Thereby all elements 2, 3 are guided on each other without play in all directions 13, 14 oriented transverse to direction 12. While shifting the guiding faces, elements 2, 3 slide on each other and may possibly still exhibit a remaining molding plasticity. Thus these faces fuse or weld on each other at the end of the insertion path under transverse pressure, i.e., in production only part 3 is first separated from the mold, while part 2 remains in the hot mold. Thereby part 3 is shifted into the operational position whereafter parts 2, 3 are commonly removed parallel to axis 10 from the mold spaces for part 2. In the casting position parts 2, 3 are located totally on separate sides of plane 16 which is perpendicular to direction 12 and in which binding 4 is located. The axial plane 17 of axis 10 or 11 is perpendicular to plane 16 and is a plane of symmetry of elements 2, 3. The guide profile of one or both elements 2, 3 has faces which are inclined relative to each other at a self-locking cone angle of less than 5° or 4°. This is evident from planes 18, 19 which are almost perpendicular to axes 11, 111. Thus each of these guide profiles is inherently tensioned and both profiles are mutually increasingly tensioned on the progressing insertion travel. Thus a press fit which is non-releasable, or releasable only by destruction, is achieved.

Figure 4:
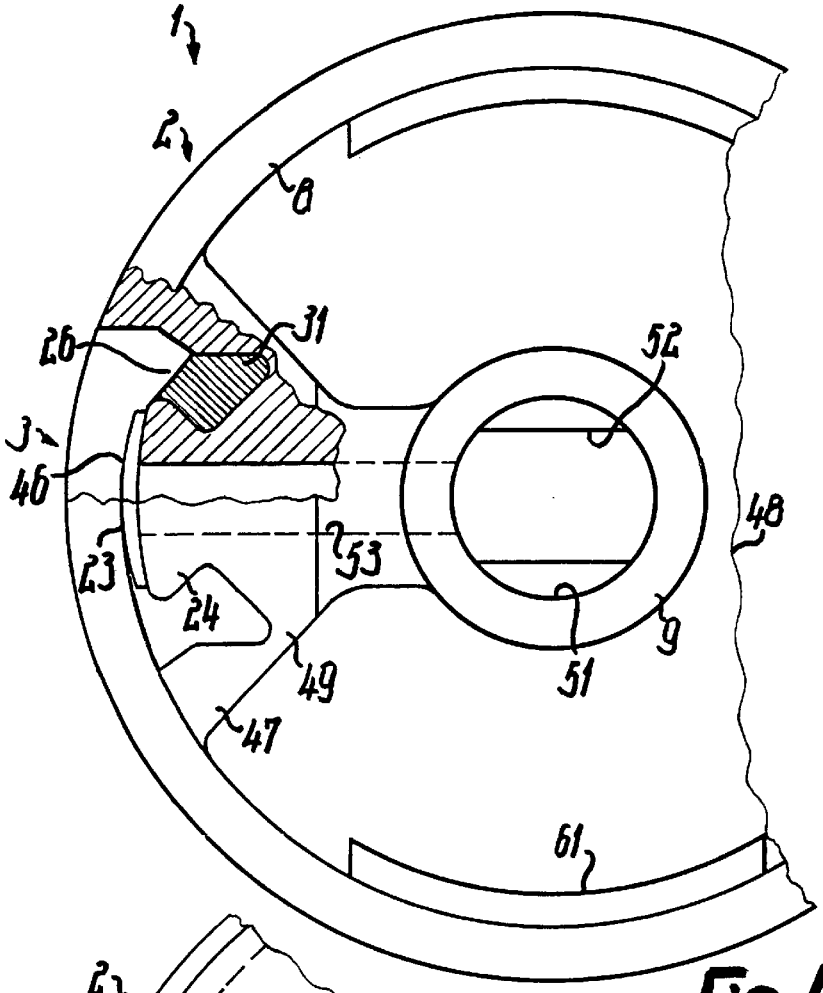
FIG. 4 is a partially-sectioned view of the arrangement shown in FIG. 2 from underneath.
Figure 5:
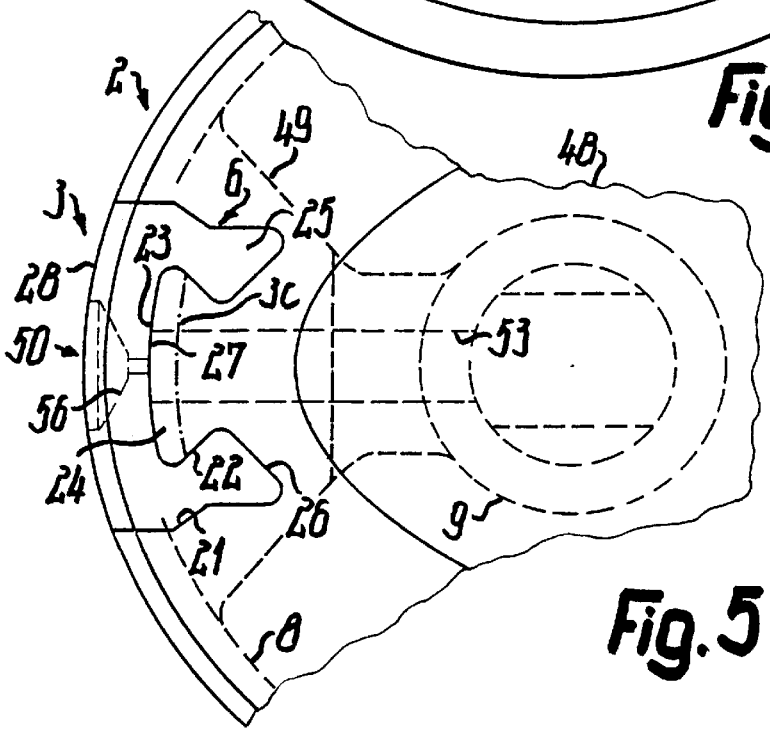
FIG. 5 is a partially-sectioned view of the arrangement shown in FIG. 2 from above.

Support 2 has its guide profile entirely in its interior. on both sides of plane 17 this profile has laterally outermost stepped and mutually opposed inner or guide faces 21 and opposite thereto guide faces 22. Inclined faces 22 are mutually remote and diverge toward a contact face 23. Face 23 is coaxially curved about axis 10 and is bounded by flanks 22 to provide a dovetail profile 24. Flanks 21, 22 bound one side of profile 24, which is bounded on another side by likewise dovetail or similarly shaped profiles 25. Each of the three profiles 21, 22, 24, 25 automatically prevents any relative motion in directions 13, 14 and fully contacts the counter profile without any spacings. The inside of the web of U-shaped cross section of insert 3 forms the contact or counter face 27 for making full contact with face 23. The insides of U-legs 26 fully contact flanks 22 and the outsides of legs 26 fully contact flanks 21. On setting in insert 3 these faces form the slide and guide faces which in the operational position form the contact and seal faces. Theses faces adjoin a breast face 29 which is in direction 12 the front-most face of insert 3 and which as evident from FIG. 2 is located in plane 16. Exclusively in plane, 16 elements 2, 3 are interconnected in one part via a micro-thin joint 30. The two connecting members 31 of this binding 30 are spaced from and located on both sides of plane 17 as partial appendices of legs 26 (FIG. 4). Elements 2, 3 are differently cross-hatched in FIG. 4 to provide better clarity despite one-part construction.

The outer or front face 28 of insert 3 is remote from back face 27, and is arcuate in shape like the outer circumference of shell 8 with the same radius about axis 10. Thus face 28 forms a smooth continuation of this outer circumference. When connecting to members 31, the legs and the web of U-shaped cross section of insert 3 may be slightly set back from to plane 16 and the coplanar end face 34 of support 2. Namely these legs and web oppose face 34 in parallel by a gap spacing of maximally 3 or 2 tenths of a millimeter. Thus insert 3 (FIG. 2) is resiliently pivotable or tiltable relative to support 2 in direction 13 and by a few angular degrees. The guide profile of insert 3 extends over the full length of insertion. The end face of insert 3 which is remote from joint 30 forms a U-shaped pressure face 40 against which a tool is urged to push insert 3 into support 2. At the end of this travel, the insert 3 abuts a counter-stop 45 of support 2 through its stop 43 which is formed by the end edge of the web of insert 3. Counterstop 45 is formed by an edge face of shell 8 and located at the end of guide 5.

According to FIG. 2 the web or stop 43 is directly juxtaposed with an inclined ramp 44 of support 2. Thereby face 23 is radially outwardly offset slightly relative to face 27. Thus, on commencement of insertion and directly on release of binding 30 the edge flanked by faces 27, 43 slides on ramp 44. Thus on further displacement the web of insert 3 is tensioned relative to legs 26 and to support 2. Thereby face 23, which is located in plane 18, then converges in direction 12 with plane 19 of face 27 at an angle of 2°. On further insertion the mutual pressure of faces 23, 27 increases until finally planes 18, 19 are parallel or coplanar due to inherent deformation. Face 40 is then located in plane 16. A rounded edge of annular cross section which interconnects shell 8 and end face 34 then uninterruptedly continues all around insert 3.

Face 23 may be formed by a plate-shaped projection 46 which is slightly slimmer than profile 24 to achieve a particularly strong seal between faces 23, 27. End wall 48 forms face 34 and has on its inside a projection 49 which bounds guide 5, forms face 23 and which is radially spaced from shaft 9. In FIG. 4 the appendage 49 is obtusely widened toward shell 8. Projection 49 is joined by legs 47 to shell 8 in one part on both sides of and with spacings from projection 24. Guides 25 thus continuously extend from end face 34 to the lower end face of lug 49 which is trapezoidally U-shaped. Projection 24 adjoins only in one part wall 48 and the web of projection 49 between the guides. Thereby lower end of projection 24 is exposed freely and resiliently pivots toward axis 10 on insertion of insert 3.

Medium outlet 50 traverses the center of insert 3 and ports into the environment, namely between legs 26 in face 28. Except for this passage the insert 3 has constant cross sections over its full length. Inside shell 9 and in axis 10 a medium or outlet duct 51 is provided. At wall 48 duct 51 adjoins a constricted transverse or guide groove 52. Duct 52 in turn transits into a transverse or first conduit 53 which is parallel to axis 11 and extends up to faces 23, 27. Conduit 53 is spaced from and located between axis 11 and face 34.

A cylindrical duct section 54 emanates from face 27 and traverses insert 3. Duct 54 has a diameter of less than one, half or a third of a millimeter and adjoins downstream a recess 56 in the outer face 28. Thus an atomizing nozzle is formed. The nozzle could also be configured to dispense discrete droplets which fall from the dispenser by their own weight. Guide means such as a swirler 60 connects upstream to duct 54. Means 60 cause the medium to rotationally flow about axis 11 and to be rotatingly guided into duct 54. For this purpose, recesses 57 to 59 are provided in a face 23 of projecting portion 46. The depth of these recesses is smaller than the thickness between the concentric cylinder faces 27, 28. The recesses include an annular duct 57 positioned around axis 11, a circular recess 58 located on the axis 11 and several ducts 59 extending tangentially from circular recess 58 to interconnect recesses 57, 58. Conduit 53 communicates between axis 11 and face 34 exclusively and directly into duct 57, from there via ducts 59 into recess 58, and thus from recess 58 directly into coaxial duct 54. Recess 58 is coaxial with axis 11.

Support or head 2 or the entire assembly 1 is to be used with a single or with two separate thrust piston pumps 32, 33 and with a dispenser base or medium reservoir 35 from which the pressure or pump chamber 37 of pump 32 is refilled with medium by suction on the return stroke. These assemblies then form a dispenser unit 20. The pressure or pump chamber 38 of air pump 33 is bounded by walls 8, 9, 48, 49 and a top surface of a piston 41. The pump 32 is braced relative to base 35 by a retaining member, such as a crimp ring 39. Member 39 locks annular piston 41 in position with respect to both axial and radial opposite directions through a beaded or multilayer snap member 42. Piston 41 clasps the outer circumference of member 42.

Piston 41 has an annular disk-shaped bottom with a yieldable, stretchable snap groove for positive engagement of member 42. Two annular lips 62, 63 conically protrude from the bottom by an obtuse angle towards plane 16. The significantly shorter and outermost lip 62 slides on the inner circumference of shell 8. The at least thrice longer lip 63 slides on the outer circumference of shaft 9 and forms therewith a slide valve 64 for input of air at the end of the return stroke. For this purpose, corresponding recesses are provided in shaft 9, which may alternatively be provided in the inner circumference of shell 8. From chamber 38 the air flows directly between faces 23, 27 and from there either into device 60 or via ducts bypassing the latter and passing directly into nozzle duct 54.

Pump 32 has a casing or housing which protrudes over the majority of its length into reservoir 35. Pump casing 65 is either formed as an integral, individual part or is assembled from an oblong housing part 65 and a cover 66. Cover 66 clasps the inner and outer circumferences of the wider end of housing 65 by sleeve appendices. A piston unit 67 is axially movable in housing 65. This unit 67 extends through cover 66 and includes a multi-part shaft 68 which extends beyond lip 63. Shaft 68 is surrounded by an axially and resiliently compressible, sleeve-shaped piston 69 which slides on the inner circumference of housing 65 and bounds chamber 37. The outer end of shaft 68 forms a connector or plug 70 for engaging and plugging into the interior of shaft 9.

Pump 32 has three valves 71 to 73. Outlet valve 71 is located entirely within unit 67. One of its valve bodies is formed by piston 69 and the other by shaft 68. Valve 71 opens as a result of pressure which in chamber 37, or results from the return stroke. Thereafter it closes again on the return stroke under the spring force of piston 69. The valve bodies of vent valve 72 are piston 69 and the inner sleeve end of cover 66. Valve 72 closes at the end of the return stroke and opens on commencement of the pump stroke. Thus air is able to flow in between unit 67 and housing 65 from the outside, after which, the air flows out in a transverse direction through openings of housing 65 so that the air is then guided along the outside of housing 65 into reservoir 35. Inlet valve 73 opens counter to a spring force when a vacuum exists in chamber 37 to thus let medium refill and flow into chamber 37 from reservoir 35 on the return stroke of unit 67. The opening of the valve 73 loads spring 74 which acts as a return spring for unit 67 and may also support shaft 68 within piston 69. Pressure-relief valves 71, 73 alternate in their operation.

The outer shell of cover 66 forms an annular flange 75 which radially protrudes from the housing. Flange 75 is axially tensioned against an edge surface of the neck of reservoir 35 by member 39 with a seal or filter 76 being interposed. Due to seal 76 tightly adjoining the outer circumference of housing 65, air from valve 72 is directed only through semi-permeable seal 76 into reservoir 35. Thereby, the air is rendered germ-free.

Figure 7:
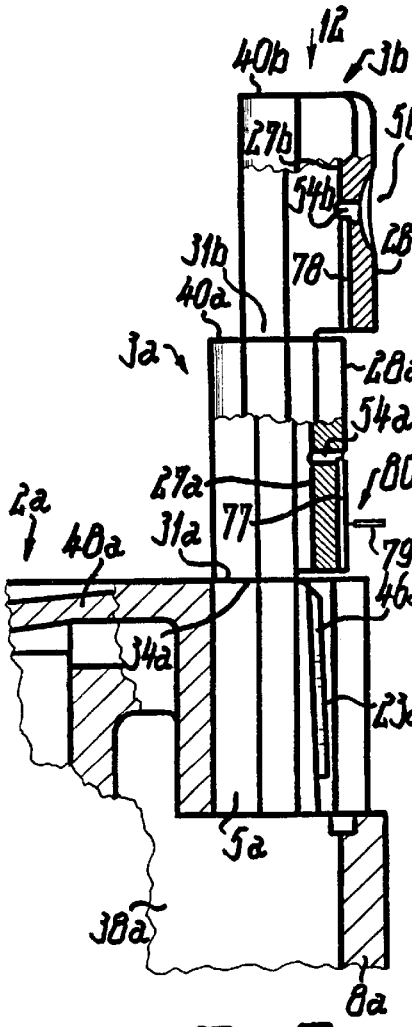
FIG. 7 is a detail corresponding to that shown in FIG. 2 but of the dispenser shown in FIG. 6.
Figure 6:
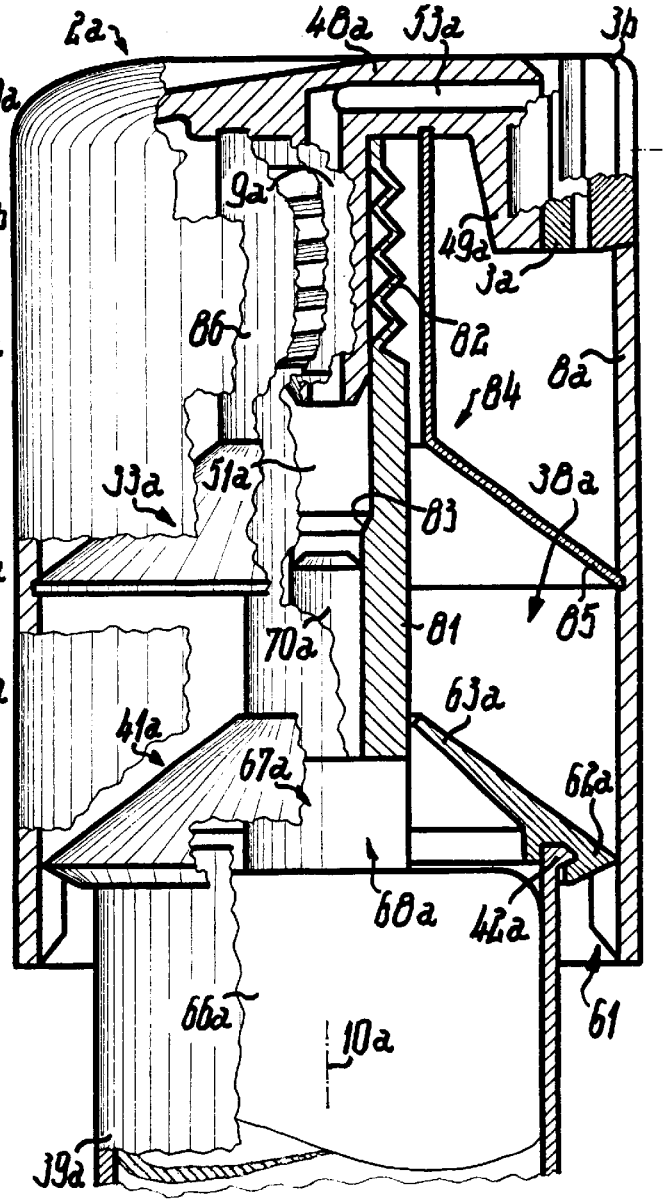
FIG. 6 is a view as shown in FIG. 1 but of another embodiment.

Referring now to FIGS. 6 and 7 parts like those in the remaining Figures are identified by like reference numerals, but are identified with a suffix letter "a", and thus all passages of the description apply likewise for all embodiments.

In FIGS. 6 and 7 two inserts 3*a*, 3*b* are assembled into one part. Nozzle body 3*a* is located upstream of nozzle body 3*b* which forms outlet 50*a*. Insert 3*a* is joined by a joint 31*a* to a face 34*a* of member 2*a*. Insert 3*b* is joined by a joint 31*b* to a corresponding face 40*a* of insert 3*a*. Insert 3*a* is thus to be appreciated as the support for part 3*b*. The legs of part 3*b* clasp the legs of part 3*a* at the outside positively as described with respect to insert 3 and profile 24. The outsides of the legs of part 3*b* correspondingly positively engage support 2*a* directly. Thus the legs of part 3*a* are located between profile 24 and the legs of part 3*b*. Instead of part 3*a* may also be a plate which is planar or curved about axis 10 with no legs corresponding to part 3*c* indicated dot-dashed in FIG. 5. Thus part 3*a* forms only a part corresponding to the wider head end of profile 24. Face 28*a* of part 3*a* forms for face 27*b* that face for mutual sealed contact which corresponds to face 23. Both parts 3*a*, 3*b* are traversed by coaxial duct sections or nozzle ducts 54*a*, 54*b*. Faces 28*a*, 27*b* commonly bound a second conduit which directly adjoins chamber 38*a*. This conduit is formed by grooves 77, 78 in only one or both of faces 28*a*, 27*b*. Conduit 72, 78 ports perpendicularly at the junction between ducts 54*a*, 54*b*.

Damming means 80 are associated with conduit 77, 78 for boosting the flow obstruction or medium pressure in chamber 38. This plate-type or pressure-relief valve 80 has valve bodies which are commonly and with parts 2*a*, 3*a*, 3*b* in one part. Despite this, these valve bodies are mutually movable or deformable so that they open and close as a function of the medium pressure. In production or casting, valve body 79 protrudes transversely from face 28*a* and is connected to face 28*a* by a film hinge. When part 3*b* is shifted fully over part 3*a* in direction 12 by pressure applied to its face 40*b* the joint 31*b*, as described, is released. Then valve body 79 is pivoted by the cross-web of part 3*b* about its film hinge toward face 28*a* into a position in which the plane of body 79 is parallel to face 28*a*. Then valve body 79 is located between faces 28*a*, 27*b* and closes conduit 77, 78. When there is an upstream overpressure the portion of body 79 adjoining the film hinge is resiliently lifted off transversely. Thus air flows at a high speed into the downstream end of duct 54*a*, entrains the medium which inflows from between faces 23*a*, 27*a* whereafter the composition flow flows out of outlet 50*a*. For valve 80 it may be expedient when recess 78 is located only downstream thereof. Thereby space is provided for pressure-dependent lift-off of valve body 79 toward face 28*b* and sealing contact on face 28*a*. Only when part 3*b* has attained its end position relative to part 3*a*, will pressure simultaneously be exerted against faces 40*a*, 40*b* of both parts 3*a*, 3*b* in direction 12 to thus insert assembly 3*a*, 3*b* into guide 5*a*.

In FIG. 6 shaft 9*a* or 68*a* has an elongation 81 which is in one part with this shaft or a separate component. In FIG. 6 shaft 81 is fixedly mounted with its ends on the outsides of shaft 9*a* and of plug 70*a*. Shaft 81 has a section 82 which is axially shortenable and extendable and which is e.g. a twin part telescopic section or a resilient bellows-section 82. Bellows 82 has a shell which is of zig-zag shape in axial cross-section due to the shell forming a single or double pitch helix like a steep spiral. Bellows 82 exclusively surrounds shaft 9*a*. Shaft 9*a* is axially and sealingly movable within the dimensionally rigid section of shaft 81 which connects to bellows 82. Thereby shaft 9*a* is displacing unit 67*a*. At the end of this first partial stroke, head 2*a* abuts the end of shell 9*a* on an inner stop 83 of the dimensionally rigid shank section or on plug 70. Thus only then unit 67*a* is synchronously driven and chamber 37 is constricted.

Shaft 81 is shortened axially and chamber 38*a* reduced in size on the first partial stroke. Thus air contained in chamber 38*a* is precompressed to already flow into duct 54*a*, 54*b* or to be still dammed by closed valve 80. In the further course of the pump stroke, the pressure increases in chamber 37 until valve 71 opens. Thereupon the medium flows through the interior of piston 69 and of plug 70 or 70*a* into duct 51 or 51*a*. Depending on the calibration of valve 80 it will open shortly before, at the same time or after opening of valve 71. Without being shown in detail, the passage of the air out of chamber 38*a* may also port in a conduit which is parallel to conduit 53*a* and provided in wall 48*a*. This conduit then leads through the nozzle plate of part 3*a* directly between faces 28*a*, 27*b* and in a transverse direction 12 into duct 54*b*.

The internal volume of head 2*a* is constricted by a wall body 84. Thus a smallest possible remaining volume of chamber 38*a* is achieved at the end of the working stroke. The limiter 84 has a conical end wall 85 on which the complementary conical piston 41*a* abuts in full contact at the end of the pump stroke and which is spaced from wall 48*a*. The narrower end of wall 85 translates into a sleeve 86. The end of sleeve 86 sealingly engages the inside of wall 48*a*. Sleeve 86 surrounds section 82 as well as shaft 9*a*. Between sleeve 86 and section 82 the chamber 38*a* is able to port into the aforementioned conduit. Body 84 is sealingly snapped into a recess by the widened rim of wall 85. This recess is in the inner circumference of shell 8*a*. Thus body 84 bounds by its outer circumference a volumetrically constant space inside cap 2*a*.

When rib 63*a* pivots under the pressure in chamber 38 about member 42*a*, the lip 62*a* is increasingly pressed against shell 8*a* like a two-armed lever. A withdrawal preventer 61 for cap 2*a* acts similarly. Preventing means 61 have cams which protrude from the inner circumference of shell 8*a*. These cams abut on lip 62*a* at the end of the return stroke under the force of spring 74. Thus the motion of the lips about member 42*a* results in an increased contact pressure and in a tighter seal of both lips. Due to lock 61 the cap 2*a* cannot be pulled off of the coupling member 70*a* or pump 32. Section 82 may be a return spring so that spring 74 also returns head 2*a* relative to piston unit into a rest position simultaneously with the return stroke of the piston unit. Thereby air is sucked into chamber 38*a*. Member 39*a* is expediently made of aluminum. Thus ring bead 42*a* is made by flanging or curling. In FIG. 1 piston 41*a* permanently supports against the outer end of housing 65, 66 and in FIG. 6 merely against member 42*a*.

The liquid medium enters means 60 at a pressure of e.g. 4 to 5 bar. Compared therewith the pressure of maximally one bar with which the air enters duct 54*b* is substantially less. Parts 2,3 or 2*a*, 3*a*, 3*b* may each be made of different plastics material having differing mechanical properties or differing colors. This can be done by two or more component injections in the mold. The length of duct 54*a* is expediently selected very short, for example not more than 0.5 or 0.25 millimeter to further enhance splitting of the medium into particles by the air flow. The size relationships shown are particularly expedient, especially when the outer diameter of head 2, 2*a* amounts to maximally 30 or 20 millimeters. All cited properties and effects my be provided precisely as described, or merely substantially or approximately so and may also greatly deviate therefrom depending on individual requirements. The features of any one embodiment may be provided in all other embodiments.

What is claimed is:

1. A dispenser for discharging media comprising:

a structural unit (1) including at least two shaped elements (2,3), said at least two shaped elements (2,3) including a support (2), said at least two shaped elements (2,3) further including an insert (3) including a medium outlet section forming a medium outlet (54, 56) and a first connecting element with at least one leg section (25) projecting transversely with respect to said medium outlet section, said support (2) being formed around a central shaping axis (10), said medium outlet (54, 56) of said insert (3) defining a duct axis (11,11') transverse to said shaping axis (10), said insert (3) being assembled with said support (2) in an insert direction (12) oriented transverse to said duct axis (11,11'), first and second conduits (53), said first and second conduits porting into said at least two shaped elements (2,3), and wherein said support (2) forms a second connecting element (26) and wherein said leg section (25) of said first connecting element of said insert (3) is slideably received in said connecting element (26) of said support (3), substantially parallel to said insert direction (12).

2. The dispenser according to claim 1, wherein means are included for connecting said first conduit (53) with a first pressure chamber (37) and said second conduit with a second pressure chamber (38) separate from said first pressure chamber (37), said support (2) and the second connecting element being formed as an integral part, said insert (3) and said first connecting element (26) being formed as an integral part, said leg section being a linear web including web flanks, at least one of said web flanks being uneven and engaging said first groove slideably only with respect to said insert direction (12).

3. The dispenser according to claim 2, wherein said first conduit (53, 54) traverses said contact faces (23, 27) oriented transverse to said duct axis (11), said conduit section and said leg section including said contact faes (26, 27), in a cross-section parallel to said duct axis (11) said conduit section and said leg section (25) providing legs of an angular structure.

4. The dispenser according to claim 2, wherein said at least one of said first and second pressure chambers (37, 38) is located within said support (2), said first and second conduits including a media outlet (50) where the medium detaches from said dispenser, said structural unit (1) including said media outlet (50), said insert (3 fixedly connecting to said support (2).

5. The dispenser according to claim 2 and further including to thrust piston pump (32) axially assembled with said support, wherein said first pressure chamber (37) is a pump chamber of said thrust piston pump (32), said support (2) including an actuating head for manually actuating said thrust piston pump (32), said actuating head bounding said pressure chamber (38).

6. The dispenser according to claim 1, wherein at least one of said at least two shaped elements (2,3) bounds a duct (57, 58, 59) including a duct end, said duct end being located in said duct axis (11), said at least two shaped elements (2,3) including contact faces (23, 27) including first and second contact faces, said first and second contact faces being sealingly interconnected and assembled substantially parallel to said insert direction (12), said contact faces (23, 27) enveloping said duct end, said first conduit (53) including a duct section (54) defining a conduit section of said duct axis (11, 11'), said conduit section and said second shaped element being linear and having remote element ends.

7. The dispenser according to claim 6, wherein said second conduit (77, 78) is longitudinally bounded by said contact faces (23, 27), said leg section including a first leg and a second leg laterally spaced and separate from said first leg, said second conduit (77, 78) being bounded by said contact faces exclusively between said first and second legs.

8. The dispenser according to claim 1 and further including a flow chamber (58) and a duct section (54) oriented parallel to said duct axis (11), wherein said first conduit (53) connects to said flow chamber (58) in a connecting direction, said second conduit connecting to said duct section (54) transverse to said connecting direction.

9. The dispenser according to claim 1, wherein said conduits of said insert (3, 36) are included in a section that includes exterior faces, namely a front face (28, 28*b*) and a back face (27, 27*b*), said exterior faces being oriented transverse to said duct axis (11), at least one of said exterior faces being entirely free of contact with said support (2), when seen in a cross-section transverse to said insert direction (12) at least one of said first connecting element and said second connecting element being a dove-tailed slide element.

10. The dispenser according to claim 9, wherein said front face (28) is entirely bounded by peripheral edges, said front face (28) being freely exposed up to said peripheral edges, said second connecting element rearwardly projecting from said back face (27) and including said peripheral edges, in a view against said back face (27) said second connecting element being linear.

11. The dispenser according to claim 9, wherein said insert (3) includes a male dovetail projecting transversely from said back face (27, 27*b*) and slideably in a female dovetail of said support (2, 2*a*, 3*a*) parallel to said insert direction (12), s aid support (2) including a male dovetail (24) projecting towards said conduit section and slideably inserted in a female dovetail of said insert (3).

12. The dispenser according to claim 1, wherein said insert (3) is tensioned against said support (2) substantially parallel to said duct axis (11), said shaped elements (2,3) including slide and seal faces (21, 22, 23, 27) which directly interconnect slideably and sealingly, prior to inserting said insert (3) said slide and seal faces (21, 18, 23, 27) diverging counter said insert direction (12), and being located in faces planes (18, 19) which are transversely interspaced.

13. The dispenser according to claim 1 and further including a second pressure chamber (38) and a piston (41) volumetrically variably bounding said second pressure chamber (38) commonly with said support (2), wherein said piston (41) is preassembled with and slidable with said support (2), said support (2) including an actuating head for manually actuating said dispenser (1) to convey the medium through said first and second conduits, at least one of said first and second conduits ending in a medium outlet (50) where the medium detaches from said dispenser, said actuating head including said medium outlet (50).

14. The dispenser according to claim 13, wherein said support (2) and said actuating head are integrated into one part that also includes a shaft (9), said piston (41) including an inner lip (63) and an outer lip (62) shorter than said inner lip (63), said inner lip (63) being guided on said shaft (19) and said outer lip (62) sealingly bounding said second pressure chamber (38) directly bounded by said actuating head.

15. The dispenser according to claim 13, wherein said second pressure chamber (38) is axially spaced from said duct axis (11), said second pressure chamber (38) being directly bounded by an end wall located between said duct axis (11) and said piston (41).

16. The dispenser according to claim 1, wherein said support (2, 2*a*) is an actuating head for manually actuating discharge of the medium, said insert (3, 3*a*, 3*b*, 3*c*) being a nozzle body of an atomizing nozzle, said conduit section being traversed by said first and second conduits in said duct axis (11), said conduit section being a plate oriented transverse to said duct axis (11), said leg section (25) including said second connecting element up to said conduit section, thereby in a cross-section transverse to said insert direction (12) said conduit section and said leg section (25) being an angular structure, in a view substantially parallel to said duct axis (11), said leg action (25) being substantially straight.

17. A dispenser for discharging media comprising:

a structural unit (1) including at least two shaped elements (2,3), said at least two shaped elements (2,3) including a support (2) and an insert (3) assembled with said support (2), said support (2) defining a shaping axis (10) and said insert (3) defining a duct axis (11, 11'), said insert (3) being assembled with said support (2) in an insert direction (12) oriented transverse to said duct axis (11, 11'), first and second conduits (53) porting into said at least two shaped elements (2, 3), and a second pressure chamber (38) and a piston (41) volumetrically variably bounding said second pressure chamber (38), wherein said piston (41) is preassembled with and slideable within said support (2), wherein said support (2) is an integral part that includes a shaft (9), said piston (41) including an inner lip (63) and an outer lip (62) shorter than said inner lip (63), said inner lip (63) being guided on said shaft (19) and said outer lip (62) sealingly bounding said second pressure chamber (38), wherein a slide valve (64) including a valve body (63) is included, wherein at least one of said inner and outer lips (63, 62) includes said valve body.

18. A dispenser for discharging media comprising:

a structural unit (1) including at least two shaped elements (2, 3), said at least two shaped elements (2,3) including a support (2) and an insert (3) assembled with said support (2), said support (2) defining a shaping axis (10) and said insert (3) defining a duct axis (11, 11'), said insert (3) being assembled with said support (2) in an insert direction (12) oriented transverse to said duct axis (11, 11'), first and second conduits (53) porting into said at least two shaped elements (2, 3) and a pump base, wherein said piston (41) and said support (2) are commonly assembled with said pump base including a cover (66), a pump housing (65), a thrust piston pump (32), a preassembled unit including a pump casing (65) and a reservoir (35) for the medium and a fastener (39) for fastening said dispenser to a dispenser base (35), said piston (41) including a holding member engaging a counter member (42) of said pump base.

19. The dispender according to claim 18, wherein said counter member (42) is a multilayer bead.

20. The dispenser according to claim 18, wherein said holding member is a snap member axially positively clasping said counter member (42).

21. A dispenser for discharging media comprising: a structural unit (1) including a support (2) and an insert (3), said insert (3) being slideably assembled with said support (2) in an insert direction (12), when assembled said insert (3) fixedly connecting to said support (2), said structural unit (1) being penetrated by a duct section (54) defining a duct axis (11), said duct axis (11) being oriented transverse to said insert direction (12), said support (2) being an integral part and said insert (3) being an integral part, and a pressure chamber (38) and a piston (41) volumetrically variably bounding said pressure chamber (38) together with said support (2), wherein said piston (41) is preassembled with and slideable within said support (2) including an actuating head for manually actuating said dispenser to convey the medium through said duct section (54).

22. A dispenser for discharging media comprising:

a dispenser base, a pump (32) including a pump base, said pump base including a pump casing and a fastener (39), said fastener fastening said pump casing to said dispenser base (35), said pump base including a counter member (42), a support (2) manually displaceable relative to said pump casing, and a pressure chamber (38) and a piston (41) volumetrically variably bounding said pressure chamber (38) commonly with said support (2), said piston (41) including a holding member substantially fixedly engaging said counter member (42), wherein said piston (41) and said support (2) are commonly assembled with said pump base, thereby said holding member is fixed to said counter member (42).

23. The dispenser according to claim 22, wherein said holding member and said counter member (42) provide a resiliently yieldable snap connection permitting said holding member to fixedly engage said counter member (42) while said piston (41) and said support (2) are commonly assembled with said pump base.

24. The dispenser according to claim 23, wherein said fastener (39) includes a cap and said counter member (42) in one integral part, said pump casing including a pump housing (65) and a casing cover (66), a shaft (9) being included and displaceable commonly with said support (2), said shaft (9) traversing said casing cover (66) and sealingly engaging said piston (41) while said shaft (9) displaces relative to said piston (41), said pump housing including a pump chamber (37) volumetrically variable by displacing said shaft (9).

* * * * *

UNITED STATES PATENT AND TRADEMARK OFFICE

CERTIFICATE OF CORRECTION

PATENT NO. : 6,427,876 B1
DATED : August 6, 2002
INVENTOR(S) : Karl-Heinz Fuchs

It is certified that error appears in the above-identified patent and that said Letters Patent is hereby corrected as shown below:

Title page,
Item [57], ABSTRACT,
Line 3, “despenser” should be -- dispenser --.

Column 4,
Line 2, “11,111” should be -- 11,11’ --.

Column 9,
Line 21, “contact faes” should be -- contact faces --.

Column 10,
Line 15, “slideably in a female” should be -- slideably inserted in a female --.
Line 17, “s aid” should be -- said -- (no space).
Line 24, “(21, 18, 23, 27)” should be -- (21, 22, 23, 27) --.
Line 31, “slidable” should be -- slideable --.

Column 11,
Line 24, “(2,3)” insert a space after “2,”.
Line 35, insert -- casing -- between “a cover”.

Signed and Sealed this

Twenty-ninth Day of July, 2003

JAMES E. ROGAN
*Director of the United States Patent and Trademark Office*